US008146177B2

(12) United States Patent
Mangone

(10) Patent No.: US 8,146,177 B2
(45) Date of Patent: Apr. 3, 2012

(54) PROTECTIVE HELMET FOR SPORTS USE AND FOR WORK USE

(75) Inventor: Antonio Vincenzo Mangone, Cavriago (IT)

(73) Assignee: Mango Sport System, S.R.L., Cella (Reggio Emilia) (IT)

( * ) Notice: Subject to any disclaimer, the term of this patent is extended or adjusted under 35 U.S.C. 154(b) by 1225 days.

(21) Appl. No.: 11/909,694

(22) PCT Filed: Feb. 21, 2006

(86) PCT No.: PCT/EP2006/001682

§ 371 (c)(1), (2), (4) Date: Sep. 25, 2007

(87) PCT Pub. No.: WO2006/099928

PCT Pub. Date: Sep. 28, 2006

(65) Prior Publication Data

US 2008/0189835 A1 Aug. 14, 2008

(30) Foreign Application Priority Data

Mar. 25, 2005 (IT) ..... RE2005A0035

(51) Int. Cl.
*A42B 1/22* (2006.01)

(52) U.S. Cl. ..... 2/417; 2/410

(58) Field of Classification Search ..... 2/410, 417, 2/418, 419

See application file for complete search history.

(56) References Cited

U.S. PATENT DOCUMENTS

| | | | | |
|---|---|---|---|---|
| 2,861,273 | A * | 11/1958 | Stuart et al. | 2/6.7 |
| 2,861,274 | A | 11/1958 | Steward | |
| 3,204,251 | A | 9/1965 | Child | |
| 3,514,787 | A * | 6/1970 | Kennedy, Jr. | 2/410 |
| 3,665,514 | A | 5/1972 | Durand | |
| 3,860,966 | A | 1/1975 | Brown et al. | |
| 3,991,422 | A * | 11/1976 | Saotome | 2/410 |
| 4,477,929 | A * | 10/1984 | Mattsson | 2/425 |
| 4,607,397 | A * | 8/1986 | Laxo | 2/410 |
| 4,827,537 | A * | 5/1989 | Villa | 2/410 |
| 5,956,776 | A | 9/1999 | Chartrand | |
| 6,108,824 | A * | 8/2000 | Fournier et al. | 2/418 |
| 6,385,780 | B1 * | 5/2002 | Racine | 2/414 |
| 7,555,788 | B2 * | 7/2009 | Schimpf | 2/6.5 |

FOREIGN PATENT DOCUMENTS

EP 0 979 619 A1 2/2000

* cited by examiner

*Primary Examiner* — Shaun R Hurley
*Assistant Examiner* — Andrew Sutton
(74) *Attorney, Agent, or Firm* — Browdy and Neimark, PLLC

(57) ABSTRACT

A protective helmet, particularly for sports and work use, including a rigid outer shell which itself comprises a front cap having a concavity able to cover at least the upper part of the cranium, and a rear cap having a concavity able to cover the rear part of the cranium. The caps are mutually movable, the rear cap being connected to the front cap in such a manner as to rotate relative to the front cap about an axis transverse to the vertical plane of symmetry of the cranium, between a raised position and a lowered position.

19 Claims, 8 Drawing Sheets

FIG.8
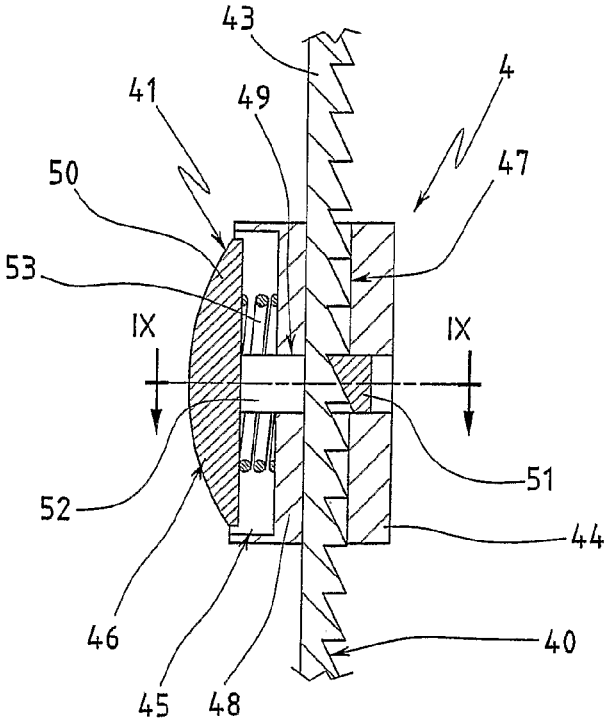
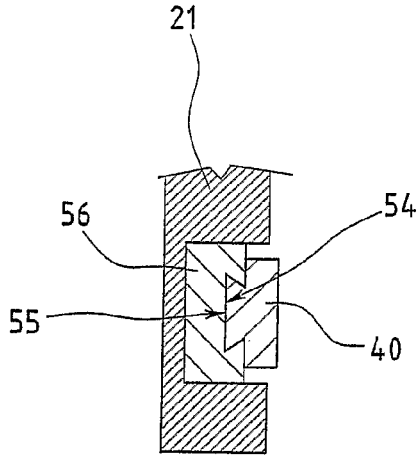
FIG.17
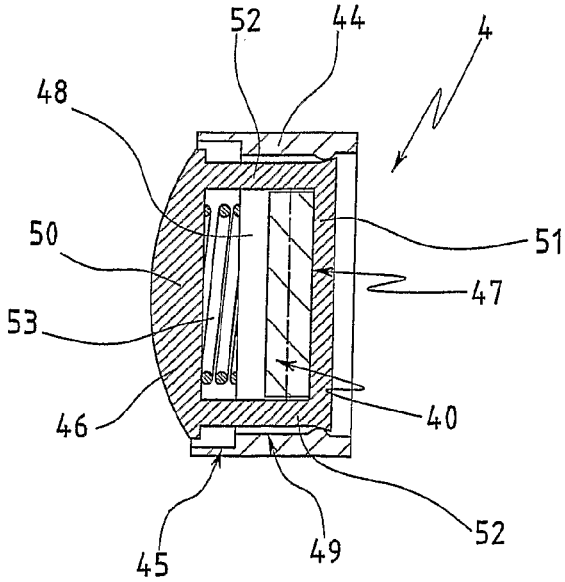
FIG.9

PROTECTIVE HELMET FOR SPORTS USE AND FOR WORK USE

TECHNICAL FIELD

The present invention relates generally to a protective helmet and, more to particularly, to a protective helmet for sports and/or work use.

BACKGROUND ART

A helmet generally comprises: a rigid outer shell to prevent direct contact between the user's head and rigid objects and to distribute the impact is force produced thereby over a large surface; and an inner shell of deformable material, typically expanded polystyrene, to absorb said impact force.

To satisfy the requirements of most users, each helmet model is available commercially in numerous different sizes.

The helmet size is a very important parameter in its choice, for reasons both of comfort and of safety. In this respect, the helmet must be able to surround the user's head so that the user's head is unable to move within the interior of the helmet and, especially, so that the helmet is unable to accidentally shift following an impact.

However, notwithstanding the variety of available sizes, the user is able to choose the helmet only within a discrete range of dimensions, which do not always exactly match user requirements.

Moreover for helmet manufacturers, the provision of numerous different sizes for each helmet model involves a considerable multiplication of production and commercial costs.

Helmets with a size adjustment system also exist, composed of an adjustable ring fixed to the helmet interior to surround the head. However, although this known system partially aids size adjustment, the head withdraws, even by a considerable extent, from the inner surface of the protective shell during adjustment, so that when an impact occurs the head itself impacts against this inner surface.

DISCLOSURE OF THE INVENTION

An object of the present invention is to overcome the stated drawbacks, by providing a helmet which adapts to the user's head while at the same time being able to accommodate, by a single model, a plurality of different sizes, so advantageously reducing the firm's production costs.

A further object of the invention is to achieve the aforesaid objects within the framework of a simple, rational and low-cost solution.

These objects are attained by a protective helmet, particularly for sports use, comprising a rigid outer shell which outer shell comprises a front cap having a concavity able to cover at least the upper part of the cranium, and a rear cap having a concavity able to cover the rear part of the cranium.

According to the invention, said front and rear caps are mutually movable, the rear cap being connected to the front cap in such a manner as to rotate relative to the front cap about an axis transverse to the vertical plane of symmetry of the cranium, between a raised position and a lowered position.

By virtue of this solution, the perimeter of the lower edge of the helmet can be infinitely modified between a maximum value and a minimum value, so reducing or increasing the helmet entry dimension.

According to the invention, the helmet also comprises an inner shell for absorbing impacts, and adjustment means for tightening/loosening said inner shell, to advantageously vary the inner width or entry of the helmet. If impact occurs, the perfect fit between the head and the protective shell reduces the impact effect and increases user safety.

BRIEF DESCRIPTION OF THE DRAWINGS

The characteristics and constructional merits of the invention will be apparent from the ensuing detailed description given with reference to the is figures of the accompanying drawings, in which:

FIG. 8 is a sectional detail of FIG. 7;

FIG. 9 is a section on the line IX-IX of FIG. 8;

FIG. 17 is a section on the line XVII-XVII of FIG. 10.

BEST MODE FOR CARRYING OUT THE INVENTION

The helmet 1 shown in the accompanying drawings is a helmet particularly designed for winter sports, and is in the form of a jet or semi-integral helmet, which leaves the user's forehead and face uncovered; however the invention can evidently relate to any type of helmet, independently of the use for which it is intended.

The helmet 1 comprises a rigid outer shell of plastic material, comprising two separate caps, namely a front cap 2 with its concavity suitable for covering the upper part of the cranium, and a rear cap 3 for covering the rear part of the cranium.

Figure 1:
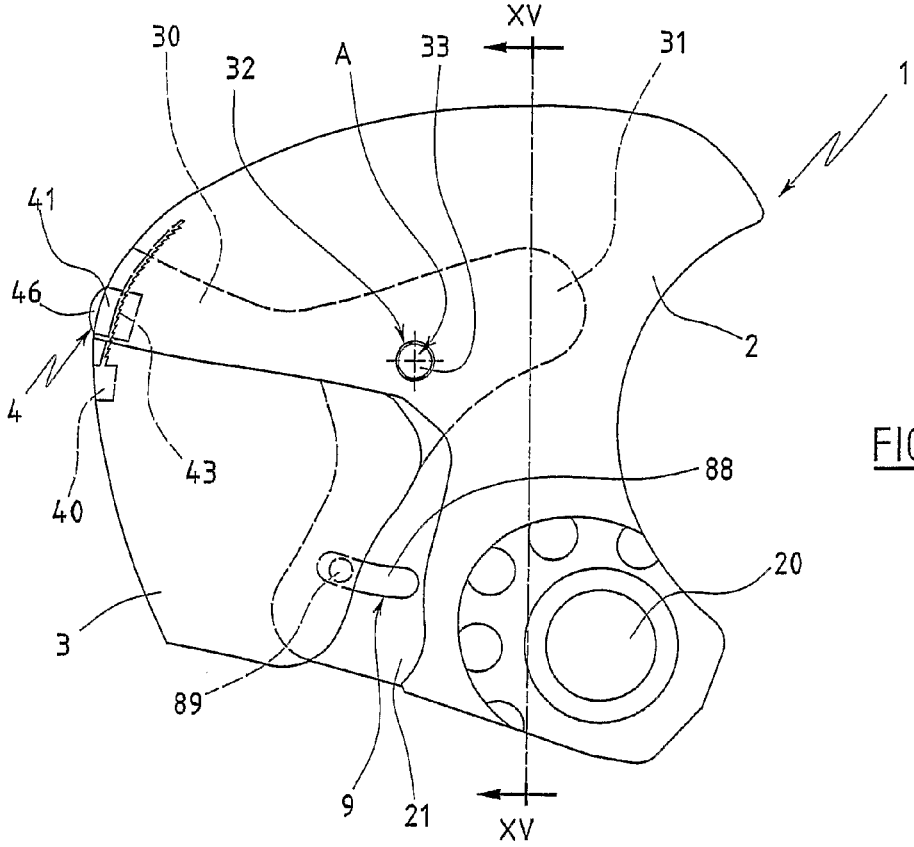
FIGS. 1 and 3 are two side views of a first embodiment of a helmet according to the invention, shown with the rear cap in its raised and lowered position respectively.
Figure 10:
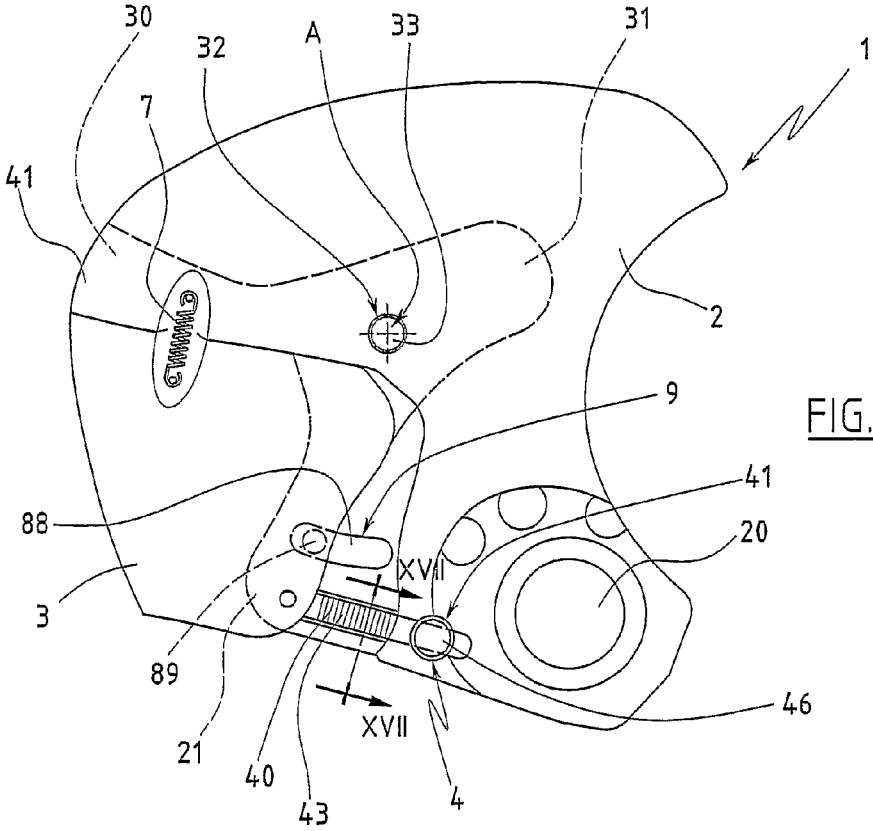
FIG. 10 is a side view of a second embodiment of the helmet of the invention.
Figure 11:
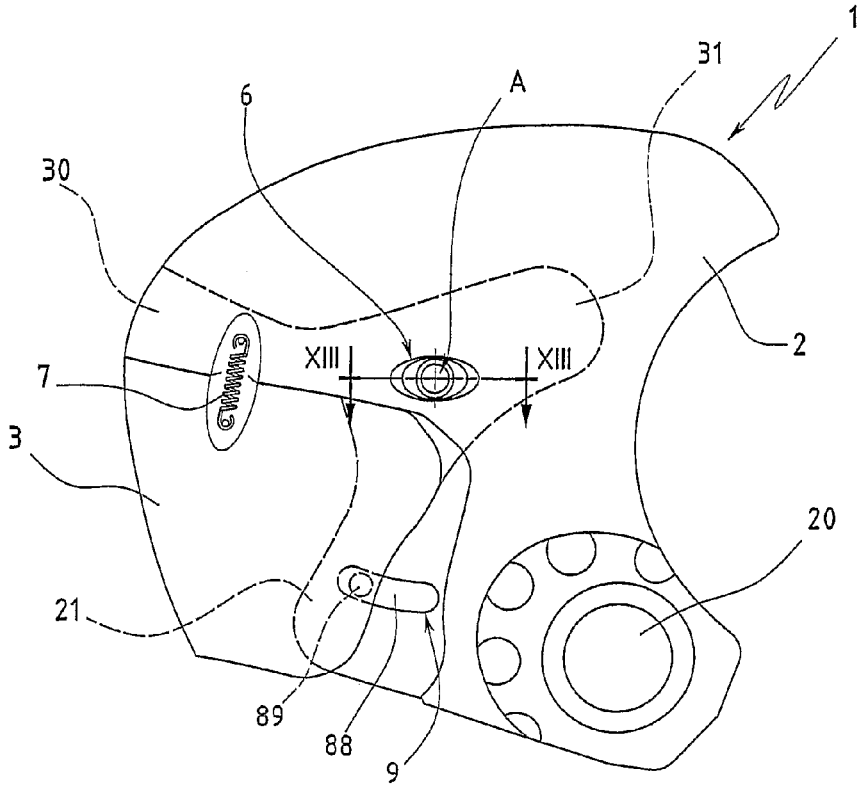
FIG. 11 is a side view of a third embodiment of the helmet of the invention.

Specifically, the front cap 2 covers the frontal and parietal bones of the cranium and is provided with two opposing lateral extensions 20 which partly cover the temporal bones of the cranium, the ears and the lateral parts of the face. The rear cup 3 covers the occipital bones of the cranium as far as the nape of the neck, and partly the temporal bones. As shown in FIGS. 1, 10 and 11, said front cap 2 and rear cap 3 are mutually movable, and are connected together such that the rear cap 3 can rotate relative to the front cap 2 about an axis A transverse to the plane of vertical symmetry of the cranium, between a raised position and a lowered position (see FIGS. 1, 5 and 3, 6 respectively).

When the rear cap 3 is in its raised position, the entry dimension of the helmet 1, indicated by B in the figures, is a maximum; whereas when the rear cap 3 is in its lowered position, said entry dimension B reaches its minimum value.

In this manner, by rotating the rear cap 3 about the front cap 2 between said raised and lowered positions, the entry dimension B of the helmet 1 is can be advantageously adjusted continuously, and hence adapted to the user's cranium.

In practice, as the invention enables the entry dimension B to be varied by about 16 mm, it enables about one half of the commercially available helmet sizes to be covered by a single model.

According to the invention, to ensure that the entry dimension B can be comfortably varied without requiring excessive travel of the rear cap 3 relative to the front cap 2, the rotation axis A must preferably be positioned within that region of the helmet 1 covering the side part of the cranium above the ear, i.e. substantially within that region covering that part of the cranium at the boundary between the parietal and temporal bones.

Figure 3:
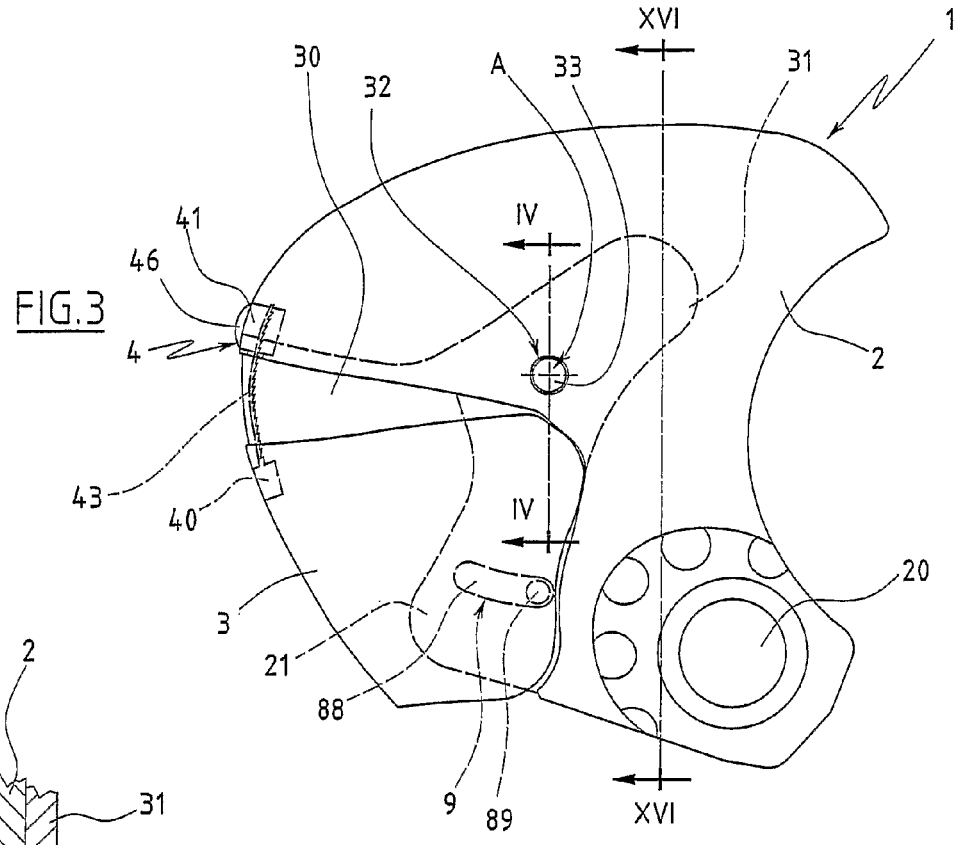

As can be seen in FIGS. 1 and 3, the front cap 2 is provided with two prolongations 21, each projecting from the rear edge of a respective extension 20 and arranged to slide in contact with the inner surface of the rear cap 3.

Likewise, the rear cap 3 is provided with a prolongation 30 projecting from its upper edge, to slide in contact with the inner surface of the front cap 2. In this manner, the outer shell of the helmet 1 advantageously preserves its own structural continuity, whatever the position assumed by the rear cap 3 relative to the front cap 2, to ensure better protection of the user's cranium.

In detail, for reasons which will be apparent hereinafter, the upper prolongation 30 of the rear cap 3 is shaped to present two opposing sidepieces 31 extending towards the front of the helmet 1 and situated in the user's temple regions.

According to the invention, the front cap 2 and rear cap 3 are connected together by hinges, the helmet 1 comprising at least one locking device able to provide a locking action, disengagable by manual control, which prevents mutual rotation between the front cap 2 and the rear cap 3. In a first embodiment of the invention, shown in FIGS. 1, 2 and 3, the rear cap 3 is hinged to the front cap 2 by a pair of hinge devices 32, each positioned on a respective lateral region of the helmet 1 and having aligned axes of rotation, to rotatably join the upper projecting prolongation 30 of the rear cap 3 to the front cap 2.

Figure 4:
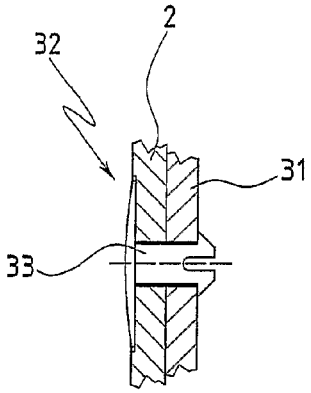
FIG. 4 is a section on the line IV-IV of FIG. 3.
Figure 7:
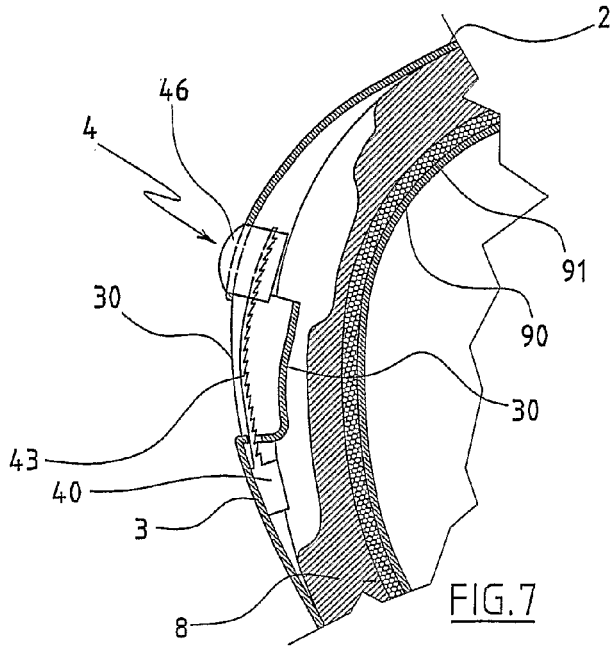
FIG. 7 shows a detail of FIG. 6.
Figure 5:
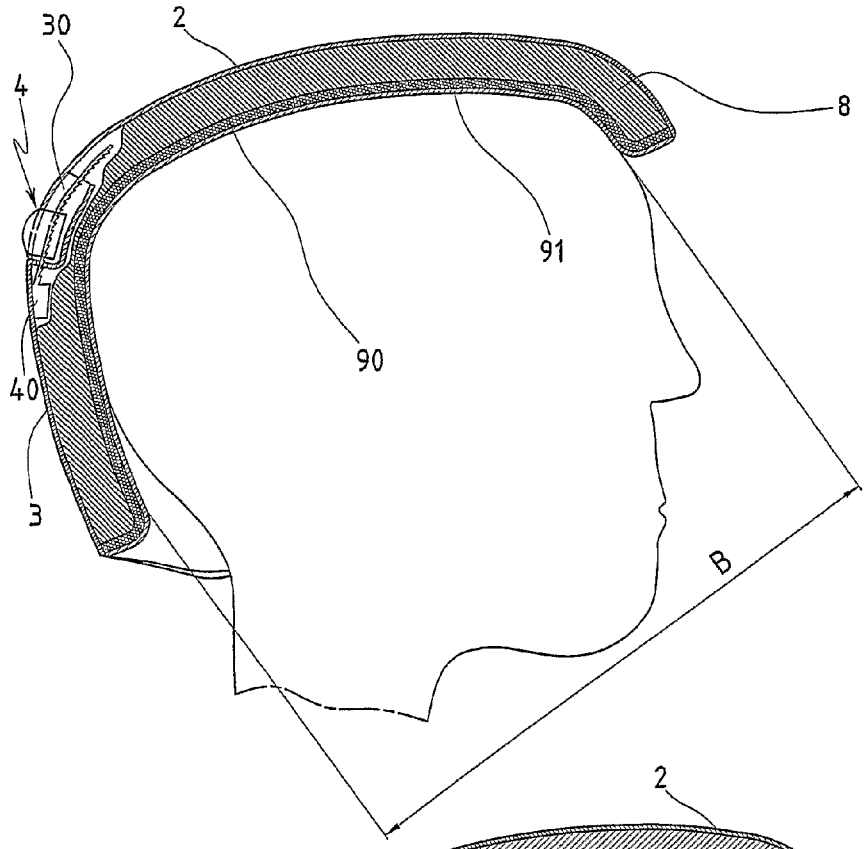
FIGS. 5 and 6 are a section on the line V-V of FIG. 2, with the helmet worn by a user and shown with the rear cap in its raised and lowered position respectively.
Figure 6:
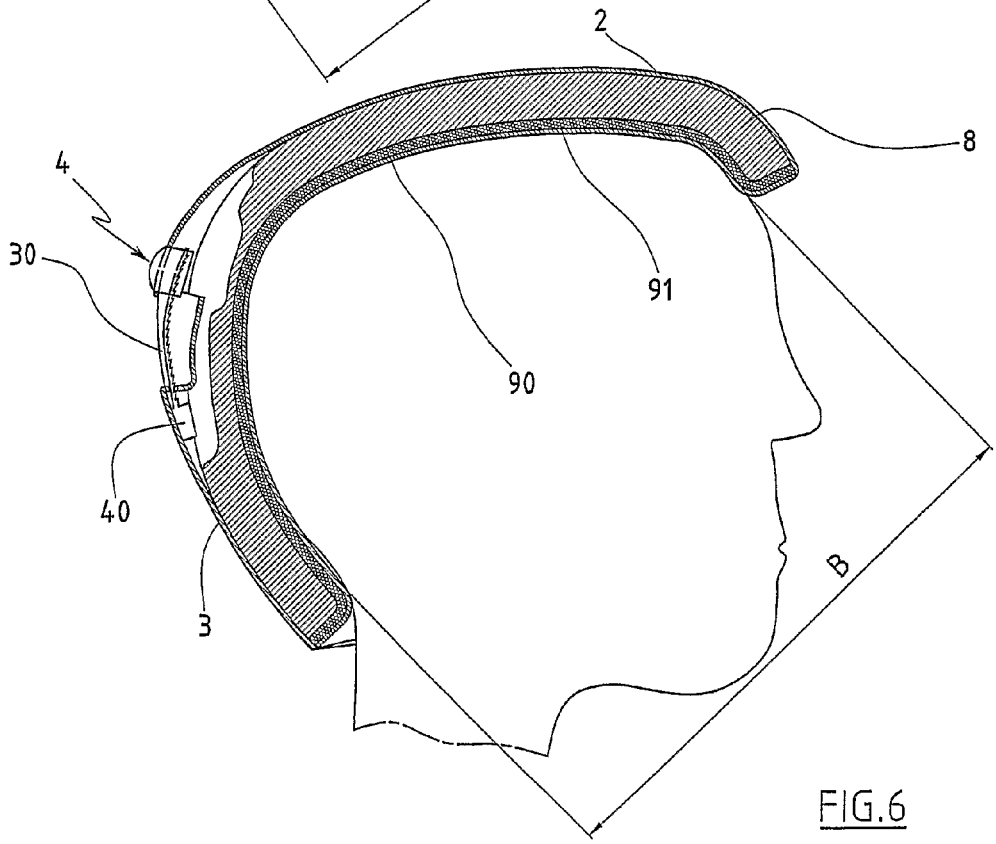

As can be seen in the sectional view of FIG. 4, each hinge device 32 comprises a snap-action peg 33 which engages in two facing holes in the front cap 2 and in the upper prolongation 30 respectively, to connect them together in an axial direction and enable them to rotate one on the other. In this embodiment, the helmet 1 is provided with a locking device 4 comprising a flexible rack 40 fixed to the rear cap 3, and an element 41 fixed to the front cap 2, in which said rack 40 engages, to be locked thereby.

In detail, the rack 40 is projectingly fixed to the rear part of the cap 3, to present a portion 43 vertically projecting from the upper edge of the cap 3; the engagement element 41 is fixed to the upper part of the front cap 2, to facing the rack 40.

As shown in FIGS. 8 and 9, said engagement element 41 comprises an outer bushing 44 provided with an axial seat 45 to slidingly receive a pushbutton unit 46, and a through transverse seat 47 in which said projecting portion 43 of the rack 40 engages.

The axial seat 45 and transverse seat 47 are mutually separated by a separating baffle 48, and are connected together by a central aperture 49 provided in said separating baffle 48.

The pushbutton unit 46 comprises an upper button 50 to be pressed with a finger, and a transverse tooth 51 positioned below the button 50, spaced from button 50 by a pair of spaced-apart lateral arms 52.

The tooth 51 has a profile matching the profile of the teeth of the rack 40, and faces the upper button 50.

The pushbutton unit 46 is contained in the outer bushing 44 such that the upper button 50 slides within the axial seat 45 against the action of a spring 53 positioned between the button 50 and the separating baffle 48, the lateral arms 52 engaging in the aperture 49 to carry the tooth 51 into the transverse seat 47.

The upper portion 43 of the rack 40 is inserted into said transverse seat 47, and slides between the lateral arms 52 of the pushbutton unit 46, above the tooth 51, with the rack teeth facing the tooth 51.

In this manner the spring 53, which urges the button 50 upwards, maintains the tooth 51 engaged in the teeth of the rack 40, to provide a ratchet action which prevents rotation of the rear cap 3 about the front cap 2 in one direction, but allows it in the other direction.

Specifically, the teeth of the rack 40 are of a sawtooth shape, and enable the cap 3 to rotate towards its lowered position.

By pressing the upper button 50 the engagement of the transverse tooth 51 is released, enabling the rack 40 to slide within the transverse seat 47 in both directions, to allow free mutual rotation of the caps 3 and 4.

In a further embodiment of the invention shown in FIG. 10, the cap 1 comprises two separate mutually opposing locking devices 4, each positioned on a respective lateral region of the helmet 1. Said locking devices 4 are positioned in that region of the helmet 1 which covers that part of the cranium lying substantially behind the ears, and are symmetrical about the plane of symmetry through the cranium.

In this second case, the rack 40 of each locking device 4 is fixed on the lower part of the rear cap 3 so that it projects from its front edge; the engagement element 41 is fixed to a respective lateral extension 20 of the front cap 2. To prevent the racks 40 from jamming within the transverse seats 47 of the respective engagement elements 41, the racks are fixed to the rear cap 3 by a hinge. In this manner, during mutual rotation of the caps 2 and 3, the racks 40 can rock and be always correctly aligned with the corresponding engagement elements 41.

In an alternative third embodiment of the invention, shown in FIG. 11, the rear cap 3 and front cap 2 are hinged together by two connection members 6, which rotatably connect the upper projecting prolongation 30 of the rear cap 3 to the front cap 2, and are each arranged to provide a locking action preventing mutual rotation of said caps 2 and 3. Said connection members 6 replace the hinge devices 32, and like the hinge devices 32, are positioned opposite each other in those lateral regions of the helmet 1 which substantially cover that cranium part above the ears, the connection members 6 being symmetrical about the vertical plane of symmetry of the cranium.

Figure 12:
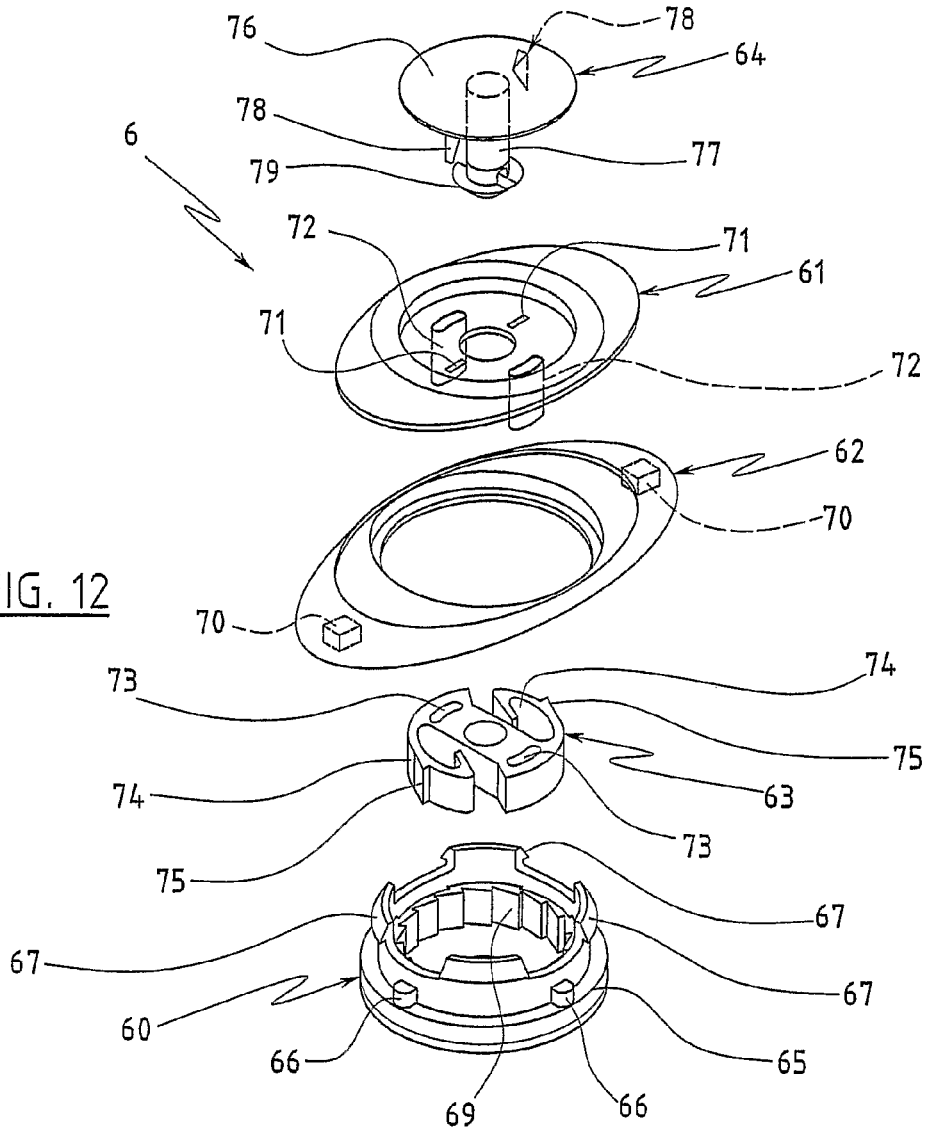
FIG. 12 is an exploded view, in side elevation, of a connection member between the front and rear caps, in that embodiment of the invention shown in FIG. 11.

As shown in the exploded view of FIG. 12, each connection member 6 comprises: a cylindrical bushing 60 to be fixed to the rear cap 3; an upper is cover 61 to close an upper opening in said bushing 60 and to be fixed to a containing frame 62 rigid with the front cap 2; a toothed disc 63 to be fixed to said upper cover 61 and to engage the interior of the bushing 60; and finally a slidable operating pushbutton unit 64.

In detail (see FIG. 13), the bushing 60 is axially contained within a circular hole 34 provided in the upper prolongation 30 of the rear cap 3, and is provided with a shoulder 65 to abut against the inner surface of said upper prolongation 30, from which a circumferential series of teeth 66 branch to engage a like number of notches provided in the edge of the hole 34, so that the bushing 60 rigidly rotates with the rear cap 3.

The bushing 60 also comprises a centrally holed closure base 68, a circumferential series of engagement lugs 67, the purpose of which will be apparent hereinafter, and an internally toothed circumferential rack 69 securely fixed to its interior.

The containing frame 62 presents a circular aperture, and is fixed to the outside of the front cap 2 by a pair of fixing teeth 70 to surround, on said front cap 2, a circular hole 22 facing and coaxial with the hole 34 of the rear cap 3.

As apparent, the upper cover 61 is contained within the containing frame 62 and is hence rigid with the front cap 2.

In detail, said cover 61 is holed in its centre, and comprises two slots 71 parallel to and slightly offset from a straight line passing through the axis of said central hole, and two projections 72 on its lower face, which are aligned along a straight line perpendicular to the axis of the central hole. Said projections 72 can each penetrate firmly into a corresponding seat 73 provided in the toothed disc 63, which is therefore rotationally rigid with is the cover 61 and hence with the front cap 2.

The toothed disc 63 comprises a central part, holed in its centre, in which said insertion seats 73 are provided, and two arcuate elastic arms 74, which each branch from a respective end of said central part and extend from opposite sides thereof.

In detail, each arm 74 is provided with a tooth 75 projecting laterally from its outer side and having a profile matching that of the teeth of the rack 69; moreover, the end portions of the arms 74 are both bent to a hook shape, and are substantially aligned along the diameter of the toothed disc 63, perpendicular to that on which the insertion seats 73 lie.

The pushbutton unit 64 comprises an upper button 76, from the lower face of which there branch an axial stem 77 and two thin wedges 78 situated on opposite sides of said stem 77.

The stem 77 terminates with a frusto-conical cap 79 divided by a diametrical slot into two flexible tangs. The wedges 78 lie in two parallel planes slightly offset from the axis of the stem 77.

Figure 13:
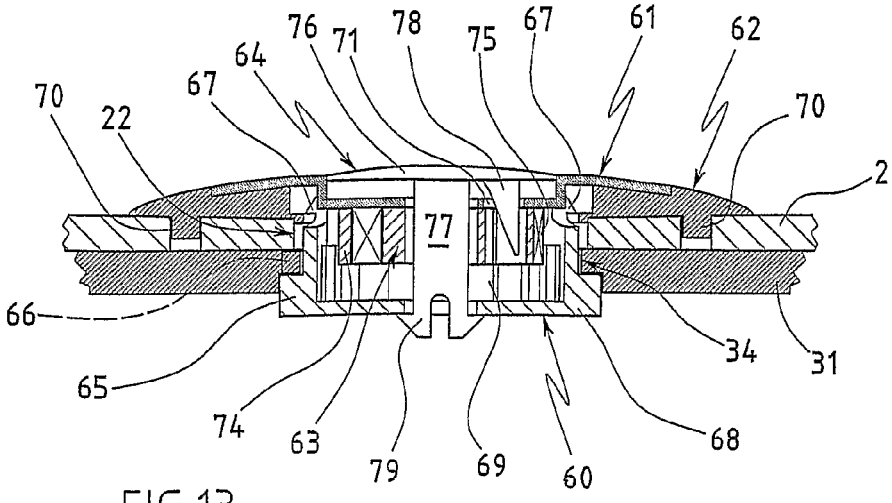
FIG. 13 is a section on the line XIII-XIII of FIG. 11.

As shown in the sectional view of FIG. 13, when the connection member 6 is mounted, the cylindrical bushing 60 is hooked to the containing frame 62 by the engagement lugs 67 which snap-fit on the edge of the circular aperture of the frame 62.

In this manner, the bushing 60 is fixed axially to the frame 62, and is free to rotate relative to the frame 62 about a common central axis, the upper prolongation 30 of the rear cap 3 hence being pivoted to the front cap 2 about this axis.

The upper cover 61 closes the compartment bounded by the bushing 60, so that the toothed disc 63 is contained within it and the teeth 75 engage in the rack 69.

The teeth of said rack 69 and the teeth 75 of the disc 63 have a sawtooth profile, this preventing rotation of the rear cap 3 about the front cap 2 towards its raised position, while allowing rotation towards its lowered position; in this respect, the elastic arms 74 carrying the teeth 75 are able to flex freely towards the centre when these arms slide over the teeth of the rack 69.

The stem 77 of the pushbutton unit 64 passes through the central holes of the cover 61, the toothed disc 63 and the base 68 of the bushing 60 respectively, so that the upper button 76 is able to slide within a corresponding compartment provided in the upper cover 61, the cap 79 acting as a limit stop by abutting against the base 68.

The wedges 78 are inserted through the slots 71 in the upper cover 61 and are each positioned inside the hook defined by a respective end portion of the elastic arms 74 of the toothed disc 63.

In this manner, by pressing the pushbutton unit 64 downwards, said wedges 78 act on the elastic arms 74 to cause them to simultaneously flex inwards and disengage the teeth 75 from the rack 69, enabling the front cap 2 and rear cap 3 to freely rotate one on the other; on releasing the to pushbutton unit 64, the elastic arms 74 tend to return elastically to their undeformed position and act on the wedges 78, to urge the pushbutton unit 64 towards its initial position.

According to the invention, the helmet 1 comprises at least one elastic return element which connects the front cap 2 to the rear cap 3 and is causes the rear cap 3 to rotate towards its raised position, i.e. in the direction prevented by the locking devices 4 or 6, making size adjustment more simple.

Figure 2:
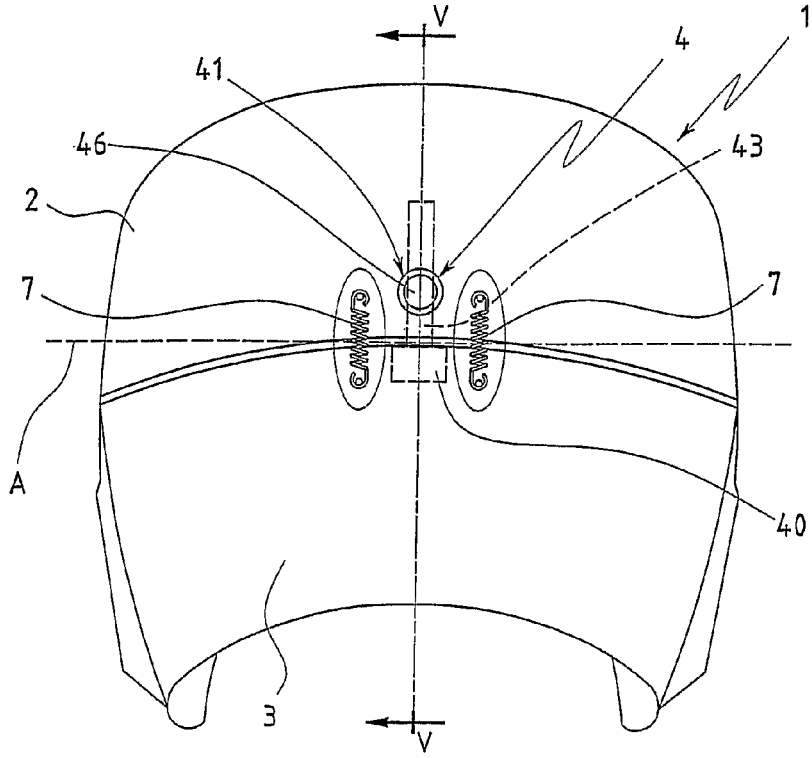
FIG. 2 is a rear view of the helmet of FIG. 1.

In the first embodiment, shown in FIGS. 1, 2 and 3, the helmet 1 comprises two return springs 7 positioned in the rear region on opposite sides of the sole locking device 4 and parallel to each other. Instead, in the second and third embodiments, shown in FIGS. 10 and 11 respectively, said return springs 7 are positioned opposing and parallel to each other within the lateral regions of the helmet 1.

Moreover according to the invention, the helmet 1 comprises, to absorb impacts, an inner shell 8, preferably of expanded polystyrene, which is generally covered with a covering comprising a soft layer 90, typically of sponge rubber, and a fabric layer 91 to lie in direct contact with the user's head.

Said inner shell 8 has a concavity such as to cover at least the upper part of the cranium, and is associated with adjustment means to enlarge/contract said concavity, in order to adapt it to different cranium dimensions.

Said adjustment means are operated by rotating the rear cap 3 about the front cap 2, and which when rotated towards its lowered position reduces the entry dimension B, to obtain simultaneous contraction of the inner shell 8.

Figure 14:
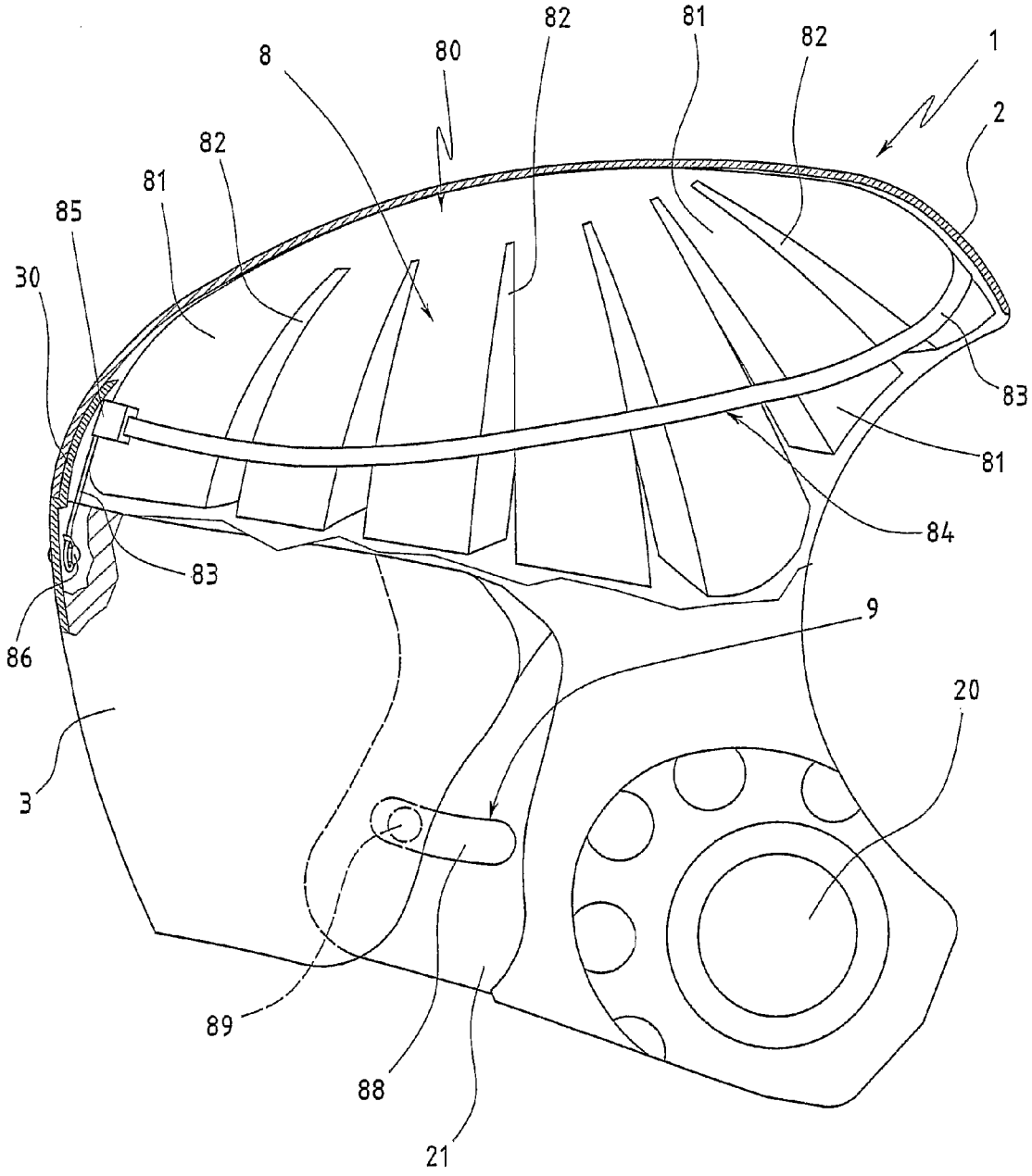
FIG. 14 is a partially cut-away view of the helmet of FIG. 1, with some to elements omitted to show details of the invention.

In detail, as visible in FIG. 14, the inner shell 8 presents an upper region 80 fixed to the inner surface of the front cap 2, and is divided into an assembly of flexible segments 81 by a plurality of slots 82 extending radially from said upper region 80.

The adjustment means comprise a strap 83 positioned as a belt surrounding all the flexible segments 81 in the upper region of the helmet 1, above the upper edge of the rear cap 3.

Said strap 83 is contained in a guide channel 84 provided in the outer surfaces of the segments 81, and is inserted through a strap clamp 85 fixed to a first end of the strap 83, such that on pulling the second end, the strap 83 tightens onto the flexible segments 81, to cause them to flex simultaneously and hence contract the inner shell 8.

As visible in FIG. 14, the second end of the strap 83 is folded to hook shape and tightened about a pin 86 fixed to the rear cap 3, so that on rotating this latter about the front cap 2 towards its lowered position, said second end is simultaneously pulled to contract the inner shell 8.

On rotating the rear cap 3 towards its raised position, the strap 83 releases the flexible segments 81, which elastically tend to assume their undeformed configuration, hence enlarging the inner shell 8.

Figure 15:
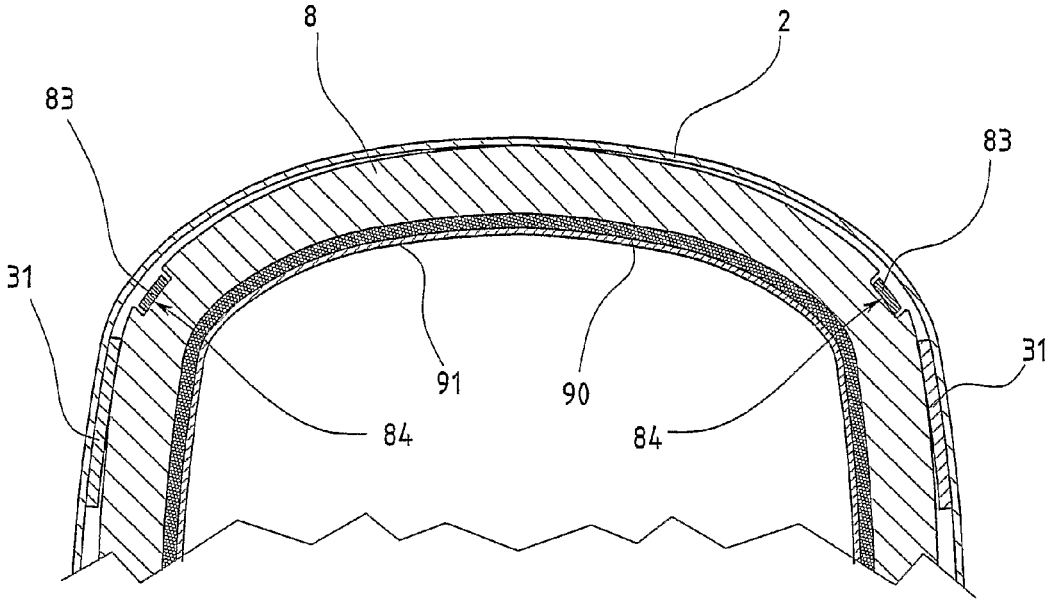
FIG. 15 is a section on the line XV-XV of FIG. 1.
Figure 16:
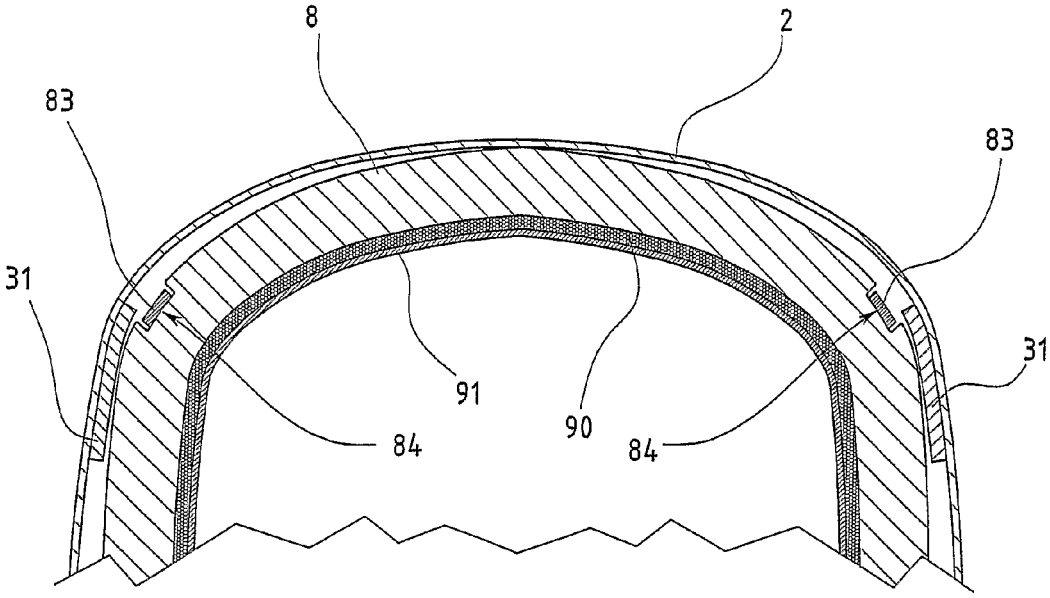
FIG. 16 is a section on the line XVI-XVI of FIG. 3.

As shown in FIGS. 15 and 16, following flexure of the segments 81, between the inner surface of the front cap 2 and the inner shell 8 there remains defined an empty space which makes the inner shell 8 less firm within the outer shell.

However this drawback is solved by the sidepieces 31 of the upper prolongation 30 of the rear cap 3 which, as shown in the figures, are to interposed between the inner surface of the front cap 2 and the inner shell 8.

In this respect, during rotation of the rear cap 3 towards its lowered position, said sidepieces 31 rotate simultaneously towards the top of the front cap 2 to occupy the empty space left by the contraction of the inner shell 8. By virtue of the concavity of the cap 2, the sidepieces 31 flex towards the interior of the helmet 1 and tighten onto the inner shell 8, to make it firmer within the outer shell.

Finally, according to the invention, the helmet 1 comprises at least one system 9 for guiding the rotation of the rear cap 3 about the front cap 2, making their engagement more stable and reliable and facilitating size adjustment.

Specifically, as shown in FIGS. 1, 3, 10 and 11, the helmet 1 comprises two separate mutually opposing guide systems 9 each positioned on a respective side of the helmet 1 and each comprising: a curved slot 88 provided in a projecting prolongation 21 of the front cap 2, and extending along a curved direction with its centre substantially on the transverse axis of rotation A; and a rigid pin 89 fixed to the rear cap 3 and projecting from its inner surface, to engage in said curved slot 88.

Alternatively, based on the second embodiment of the invention shown in FIG. 10, each guide system 9 can be replaced by a guide system integrated into a respective locking device 4.

As shown in FIG. 17, said alternative guide system comprises a dovetail profile 54 projecting from that face of the rack 40 opposite the toothing, to slidingly engage in a matching groove 55 provided in a respective insert 56 fixed to the projecting prolongation 21 of the front cap 2.

Numerous modifications of a practical and applicational nature can be made to the present invention, but without leaving the scope of the inventive ideas as claimed below.

The invention claimed is:

1. A protective helmet, for sports and work use, comprising a rigid outer shell, the outer shell comprising a front cap (2) having a concavity able to cover at least the upper part of the cranium, and a rear cap (3) having a concavity able to cover the rear part of the cranium, wherein said caps (2, 3) are mutually movable, the rear cap (3) being connected to the front cap (2), in such a manner as to rotate relative to front cap (2) about an axis (A) transverse to the vertical plane of symmetry of the cranium, between a raised position and a lowered position, further comprising an inner shell (8) to absorb impacts intended to remain interposed between the cranium and the outer shell, and an adjustment unit (83) for contracting/enlarging said inner shell (8) in order to vary its edge perimeter, wherein said adjustment unit is controlled by the outer shell's rear cap (3), such that rotating the rear cap (3) towards a lowered position results in contraction of the inner shell (8).

2. A helmet as claimed in claim 1, wherein at least one cap (2, 3) comprises respective prolongations (21, 30), substantially in contact with the inner surface of the other cap (2, 3) under mutual sliding, and arranged to ensure continuity of the outer shell of the helmet (1).

3. A helmet as claimed in claim 1, wherein said front cap (2) and said rear cap (3) define together the entry dimension (B) which varies through their mutual rotation.

4. A helmet as claimed in claim 1, further comprising at least one locking device (4, 6) providing a locking action, disengagable by manual control, which prevents mutual rotation between the front cap (2) and the rear cap (3).

5. A helmet as claimed in claim 1, further comprising two mutually opposing locking devices (4, 6), each positioned on a respective lateral region of the helmet (1).

6. A helmet as claimed in claim 5, wherein the locking device (4, 5) comprises:

a rack (40, 69) rigid with one of the caps (2, 3);

a toothed element (51, 68) rigid with the other cap (2, 3) to engage in said rack (40, 69) in such a manner as to provide a locking action which prevents mutual rotation between the caps (2, 3), at least in one direction; and elastic means (53, 74) which normally maintain the toothed element (51, 63) engaged in the rack (40, 69).

7. A helmet as claimed in claim 6, wherein the teeth of the rack (40, 69) are of a sawtooth shape to enable the rear cap (3) to rotate about the front cap (2), towards its lowered position.

8. A helmet as claimed in claim 5, wherein the locking device (4, 6) comprises:

an outer bushing (44) rigidly fixed to the front cap (2);

a pushbutton unit (46) which slides within an axial seat (45) provided in said outer bushing (44) and presents an upper button (50) to be pressed by a finger, and at least one tooth (51) positioned spaced from and facing the upper button (50);

a rack (40) fixed rigidly to and projecting from the rear cap (3), having an projecting portion (43) engaging in a transverse seat (47) provided in said outer bushing (44), such as to slide between the tooth (51) and the upper button (50) of the slidable pushbutton unit (46), and having teeth facing the tooth (51); and elastic means (53) urging the slidable pushbutton unit (46) upwards such as to press the tooth 51 into engagement with the teeth of the rack (40).

9. A helmet as claimed in claim 5, wherein the locking device (4, 6) comprises:

a hinge device pivoting the rear cap (3) to the front cap (2) and comprising a cover (61) fixed to one of said caps (2, 3), and a cylindrical bushing (60) which is fixed to the other cap (2, 3), is axially constrained to said cover (61) and is free to rotate relative to the cover (61) about a cylindrical bushing axis;

a circumferential rack (69) coaxial to and rigid with said cylindrical bushing (60) and having internally facing teeth;

a toothed element (63) rigid with said cover (61) and contained within said bushing (60), and comprising at least one elastic arm (74) which carries at least one tooth (75) normally engaged in the teeth of said rack (69); and a slidable pushbutton unit (64) provided with an upper button (76) to be pressed with a finger and comprising control means (78) which cause the arm (74) to flex and the at least one tooth (75) to disengage when the pushbutton unit (64) is pressed.

10. A helmet as claimed in claim 1, further comprising at least one elastic element (7) positioned to connect the front cap (2) to the rear cap (3) such as to urge the rear cap (3) to rotate about the front cap (2), towards its raised position.

11. A helmet as claimed in claim 1, comprise a strap which surrounds the inner shell edge perimeter, having a first end and a second end, such that on pulling the second end, the strap (83) tightens on the inner shell (8), hence contracting it, under rotation of the rear cap (3) with respect to the front cap (2).

12. A helmet as claimed in claim 11, wherein the inner shell (8) comprises an upper region (80) fixed to the front cap (2) and a plurality of radial slots (82) extend from the upper region (80) which divide the inner shells (8) into an assembly of flexible segments (81), the adjustment means comprising a strap (83) which surrounds said flexible segments (81), has one end fixed to the rear cap (3) and is able to pull the flexible segments (81) towards each other in order to contract the inner shell (8) or, alternatively, is able to release said flexible segments (81) in order to enlarge the inner shell (8).

13. A helmet as claimed in claim 11, wherein the rear cap (3) comprises two sidepieces (31) positioned respectively in the lateral regions of the helmet (1) and extending into the temple regions, to remain interposed between the front cap (2) and the inner shell (8);

said sidepieces (31) rotating towards the top of the front cap (2) on rotating the rear cap (3) towards its lowered position, in order to at least partially occupy the space left empty by the contraction of the inner shell (8).

14. A helmet as claimed in claim 1, further comprising, for guiding the rotation of the rear cap (3) about the front cap (2), at least one system (9) comprising two mutually engagable parts (88, 89, 54, 55) slidable with respect to one another, of which a first part (89, 55) is rigid with the front cap (2) and a second part (88, 54) is rigid with the rear cap (3).

15. A helmet as claimed in claim 1, further comprising two separate mutually opposing guide systems (9) each positioned on a respective lateral region of the helmet (1).

16. A helmet as claimed in claim 15, wherein the guide system (9) comprises a rigid pin (89) fixed to the rear cap (3) and projecting through a slot (88) which is provided in the front cap (2) and extends in a curved direction with its centre substantially on the transverse rotation axis (A).

17. A helmet as claimed in claim 15, wherein the guide system comprises a projecting dovetail profile (54) with the rear copy (6) and equipped in a matching slot (56) provided in the front cap (2).

18. A protective helmet, for sports and work use, comprising a rigid outer shell, the outer shell comprising a front cap (2) having a concavity able to cover at least the upper part of the cranium, and a rear cap (3) having a concavity able to cover the rear part of the cranium, wherein said caps (2, 3) are mutually movable so reducing or increasing a helmet entry dimension (B) to make size adjustments, the rear cap (3) is rotatably connected to the front cap (2), by a pair of hinge devices (32, 6) having aligned axes of rotation, so as to rotate relative to front cap (2) about an axis (A) transverse to the vertical plane of symmetry of the cranium, placed in position substantially within that region covering the part of the cranium at the boundary between the parietal and temporal bones, further comprising, to absorb impacts, an inner shell (8) intended to remain interposed between the cranium and the outer shell, and a strap (83) for contracting/enlarging said inner shell (8) in order to vary its edge perimeter, having a first end and a second end, such that on pulling the second end, the strap (83) tightens on the inner shell (8), hence contracting it, under rotation of the rear cap (3) with respect to the front cap (2).

19. A helmet as claimed in claim 15, wherein the guide system comprises a projecting dovetail profile (54) rigid with the rear cap (3) and engaged in a matching slot (56) provided in the front cap (2).

* * * * *